US007856796B2

(12) United States Patent
Trebilcock et al.

(10) Patent No.: US 7,856,796 B2
(45) Date of Patent: Dec. 28, 2010

(54) METHOD FOR SECURING AN AUTOMATIC WASHER FOR SHIPPING

(75) Inventors: Gary L. Trebilcock, Canfield, OH (US); Christopher D. Donadio, Warren, OH (US); Al Thompson, Marysville, OH (US)

(73) Assignee: Litco International, Inc., Vienna, OH (US)

( * ) Notice: Subject to any disclaimer, the term of this patent is extended or adjusted under 35 U.S.C. 154(b) by 911 days.

(21) Appl. No.: 11/799,002

(22) Filed: Apr. 30, 2007

(65) Prior Publication Data

US 2008/0264806 A1 Oct. 30, 2008

(51) Int. Cl.
*B65B 61/00* (2006.01)

(52) U.S. Cl. ..... 53/415; 53/472

(58) Field of Classification Search ..... 53/415, 53/410, 472, 432, 128.1, 135.1, 139.5, 95, 53/79

See application file for complete search history.

(56) References Cited

U.S. PATENT DOCUMENTS

| | | | | |
|---|---|---|---|---|
| 3,249,215 | A | 5/1966 | Kelly | |
| 3,321,071 | A | 5/1967 | Elwell | |
| 3,335,849 | A | 8/1967 | Collin | |
| 3,620,365 | A | 11/1971 | Elwell | |
| 3,809,232 | A | 5/1974 | Kennington | |
| 3,812,959 | A | 5/1974 | Brennan | |
| 3,861,525 | A | 1/1975 | Collin | |
| 3,896,930 | A | 7/1975 | Collin | |
| 3,904,039 | A | 9/1975 | Anyon | |
| 3,913,736 | A | 10/1975 | Brennan | |
| 4,366,902 | A * | 1/1983 | Fanson et al. | 206/320 |
| 4,624,117 | A | 11/1986 | Ory et al. | |
| 4,793,123 | A * | 12/1988 | Pharo | 53/449 |
| 5,259,218 | A * | 11/1993 | Broadbent | 68/12.06 |
| 5,340,632 | A * | 8/1994 | Chappuis | 428/71 |
| 5,533,367 | A | 7/1996 | Lybarger et al. | |
| 5,819,942 | A * | 10/1998 | Sadow | 206/522 |
| 5,901,850 | A * | 5/1999 | Jones et al. | 206/522 |
| 6,464,079 | B1 * | 10/2002 | Newman | 206/522 |
| 6,629,777 | B2 * | 10/2003 | Tanaka et al. | 383/3 |
| 6,729,110 | B2 * | 5/2004 | Sperry et al. | 53/503 |
| 7,014,160 | B2 | 3/2006 | Muyskens | |

FOREIGN PATENT DOCUMENTS

| | | |
|---|---|---|
| JP | 03-240666 | 10/1991 |
| JP | 04-128159 | 4/1992 |
| JP | 06-156573 | 6/1994 |
| JP | 07-041075 | 2/1995 |
| JP | 09-156680 | 6/1997 |
| JP | 09-315483 | 12/1997 |
| JP | 10-236573 | 9/1998 |

* cited by examiner

*Primary Examiner*—Paul R Durand
(74) *Attorney, Agent, or Firm*—Robert J. Herberger

(57) ABSTRACT

A method for securing the drum casing of a washer during shipping includes at least one airbag for wedging between the drum casing and washer housing. The preferred airbag has three arm extensions, although a bag with two arm extensions, or two separate bags could be used. Two of the extensions, or two separate bags, whichever is used, are positioned around the washer drum exterior to prevent free, lateral movement of the drum casing relative to the housing. The third arm of a three arm bag is slid between the drum casing and rear washer housing before inflating. Preferably included with this method is a spacer for wedging between the drum and a housing bracket to prevent free, vertical movement of the drum relative to its washer housing.

19 Claims, 7 Drawing Sheets

METHOD FOR SECURING AN AUTOMATIC WASHER FOR SHIPPING

BACKGROUND OF THE INVENTION

1. Field of the Invention

This invention relates to an apparatus for securing an appliance for shipping. The apparatus may be included in a kit used by commercial moving companies, or by private individuals who would need to secure the drum of a washing machine, or washer, for transport. Particularly, this invention braces the rotatable drum against the housing of a washing machine having little or no centrally located agitator. It is most applicable for today's front loading washers, and a few top loading varieties for which standard agitator securing means will not suffice.

2. Description of Related Art

Because of the sensitive nature of internal components to many appliances such as washing machines, and their relatively low resistance to shock, it is critical that the rotating drum, for example, be stabilized before transportation. This is true for both front loading washers and top loading machines, particularly those having very little to no centrally located, fabric agitator. The present invention provides a securing apparatus and method for securing the drum component in the housing of such machines for safe, cost effective shipping and transport.

Today's typical automatic washing machine includes an operational assembly or system, often referred to as the moving system. It has various components for washing and rinsing fabrics placed in the machine proper. Typical major operational components for a top loading washer include an outer, imperforate tub for holding fluids, an inner perforate basket for holding a quantity of fabrics to be washed, an agitator for moving the fabrics about in the fluid, a pump for circulating and draining the fluid, a motor and a transmission for operating the agitator and pump to spin the basket. The operational assembly, or system, is mounted in a stationary housing and is moveable relative to that housing for accommodating the high degree of rotational and other forces generated during normal operation of the machine. The forces often exerted on a machine during shipment can cause excessive movement and shock to the operational system, with attendant damage. A number of approaches have been taken to prevent damage to the machine during shipping or transport.

For most top loading washers, numerous devices have been disclosed for securing the drums of these machines/appliances during temporary transport. Some secure the rotating, internal drum by positioning various devices beneath the washer lid. For example, Elwell U.S. Pat. No. 3,321,071 includes a plastic, shelf-like unit for installing over the agitator of a top loading washer prior to servicing and/or shipment. In Kelly U.S. Pat. No. 3,249,215, the washer agitator is surrounded by a ring from which several clamp-like supports extend.

Collin U.S. Pat. No. 3,896,930 braced his washer agitator from beneath the lid assembly with a plurality of radially spaced, rigid foam plastic braces. Earlier, the same inventor used a two piece section of stiff matting having a bendable collar, a central opening and tabs for jamming into place beneath a washer lid. See, Collin U.S. Pat. No. 3,335,849.

A slitted block of resilient plastic, hinged about a central aperture for the top to the drum agitator is disclosed as the washing machine packing brace in Kennington U.S. Pat. No. 3,809,232. A somewhat similar agitator brace packing extends from under the top-loading washer lid in Brennan U.S. Pat. No. 3,812,959. It represents an improvement over the earlier packing brace of Elwell U.S. Pat. No. 3,620,365. Later, Brennan would disclose a thick foam variation in his U.S. Pat. No. 3,913,736. A four-sided variation over the Brennan triangular configurations, using foam for wedging, was patented by Anyon in U.S. Pat. No. 3,904,039.

The shipping system of Fanson et al. U.S. Pat. No. 4,366,902 used a split block of foam above the top-loading washer drum, but supplemented that with a lower shipping brace, attached to foot holes in the washer base.

Still other top-loading washer securing means require a plurality of locking clamps or rods, typically positioned from the washer bottom, beneath its rotating drum. Representative of these are the shipping restraint system of Ory et al. U.S. Pat. No. 4,624,117 and Lybarger et al., U.S. Pat. No. 5,533,367.

In Muyskens U.S. Pat. No. 7,014,160, yet another washer securing means is disclosed. It requires placing the top-loading washer in a tray from which upwardly extends a multi-tiered, diamond-like corrugated blank for holding the washer drum from beneath. Many international equivalents are known for securing the rotating drum of a washer appliance from beneath, with trays of corrugated cardboard and/or polystyrene foam. See, for example, Japanese Published Patent Nos. 04-128159, 06-156573, 07-041075, 09-156680, 09-315483 and 10-236573.

Finally, in Collin U.S. Pat. No. 3,861,525, there is shown a top-loading washer securing means that employs a plurality of foamed plastic, elongated wedges, each wedge being slotted and sloping upward at one end with multiple grooves at its opposite end.

In recent years, there has been an increase in popularity of the front loading washers more common in Europe for decades. Higher capacity versions of these models, newer to the United States, can be made more efficient in their overall use of energy, water loads and soaps or detergents needed per load. The front loading appliances share much in common with their top-loading counterparts except that most do not require a separate, centrally rotating agitator in their basket or drum. Gravity forces the fabrics being cleaned to rise and fall in these units as their tubs rotate mechanically. Some top loading models have also been developed with an agitator-less fabric cycling means. See the Calypso brand washing plate of Whirlpool.

Regardless of rotating drum positioning, and the means by which fabrics are loaded into same (either front or top-loading), special care must be taken to safeguard the internal mechanicals to such machines when transporting them from place to place, either with their initial purchase or with subsequent relocations.

SUMMARY OF THE INVENTION

It is an object of this invention to provide an improved alternative appliance securing apparatus as part of a shipping kit. It is another object to provide a method for transporting washing machines, especially front loading types and the top loading machines that have virtually no centrally located, agitator. It is another object to provide an improved shipping kit that involves few components and has a minimal environmental impact for disposal after use.

An apparatus for securing the drum of a washer during shipping comprises at least one airbag for wedging between the drum and washer housing. A preferred model of airbag has two arm extensions for positioning around the washer drum exterior. A third arm may be slid between the drum and rear washer housing before inflating. These airbags are included with several widths of spacers for wedging between the drum and washer housing bracket to form a shipping kit. A method for securing washers with such a kit is also disclosed.

BRIEF DESCRIPTION OF THE DRAWINGS

Further features, objectives and advantages of the present invention will become clearer when referring to the following detailed description of preferred embodiments made with reference to the accompanying drawings in which.

DETAILED DESCRIPTION OF PREFERRED EMBODIMENTS

As used herein, the term "plurality" means one or more, or "at least one" of a given item, component or element. It does not necessarily require a plural, or more than one of any particular unit.

Figure 1:
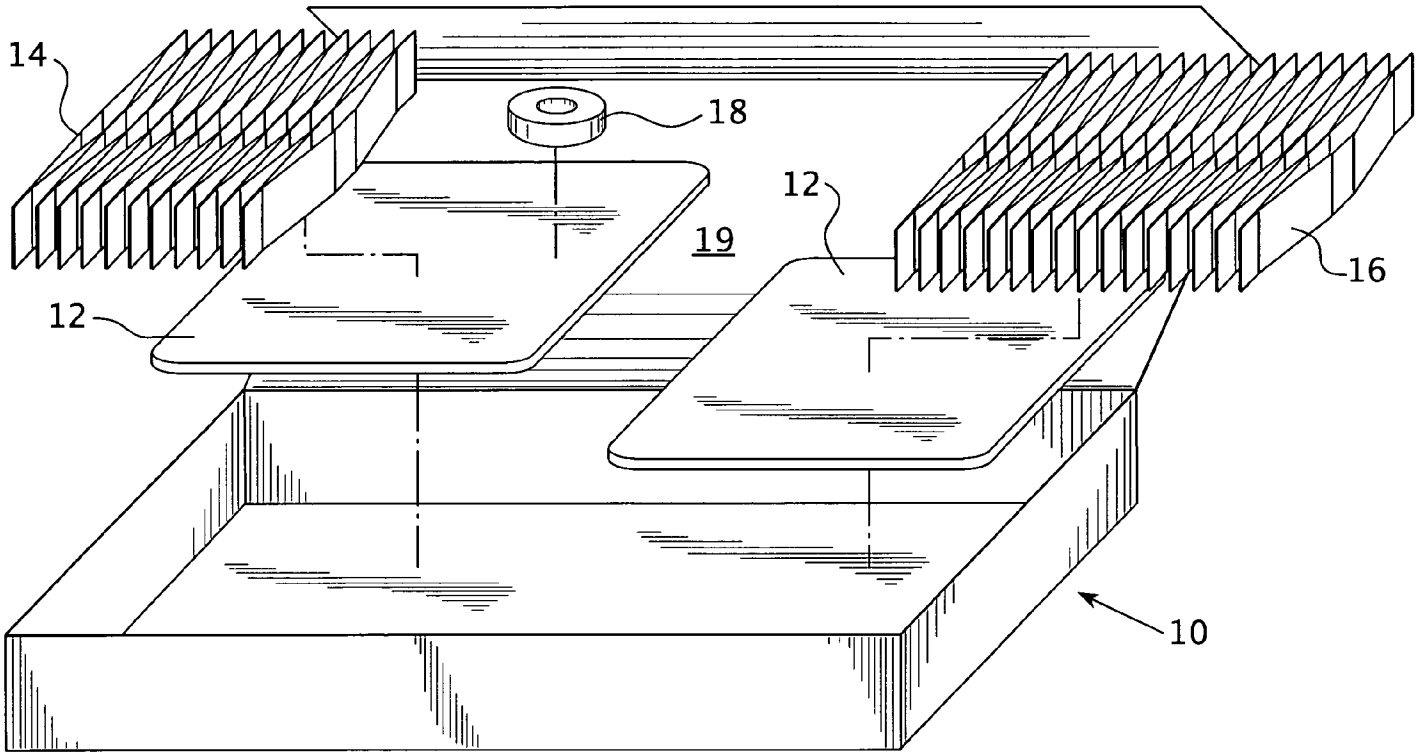
FIG. 1 is a perspective schematic view of a washer shipping kit according to one embodiment of this invention.

Referring now to the FIG. 1, there is shown a preferred embodiment of shipping kit 10 according to this invention. A main component of this kit is the airbag 12. As shown, the kit includes two airbags that are polymer bladdered, but with an outer paper exterior made from two ply of Kraft paper, preferably waxed or polyethylene coated for better friction resistance. A representative airbag is made and sold as a RIDE RITE® bag by Kapstone Kraft Paper Company. One preferred size of bag 12 measures about 18×28 inches when not inflated. Depending on the washer to be secured, these bags may be positioned on the inner sizes, between the washer drum and housing, or folded in half for wedging between washer drum and washer housing interior before inflating.

Kit 10 further includes two or more sets of cellblocks, or spacers. A first spacer 14 measures roughly 3 inches in width. A second included spacer 16 is about 5 inches wide. Both spacers are strips of corrugated cardboard, folded to an accordion-like shape. An optional roll of tape 18 may be added to the kit container 19 along with written instructions (not shown).

Figure 2:
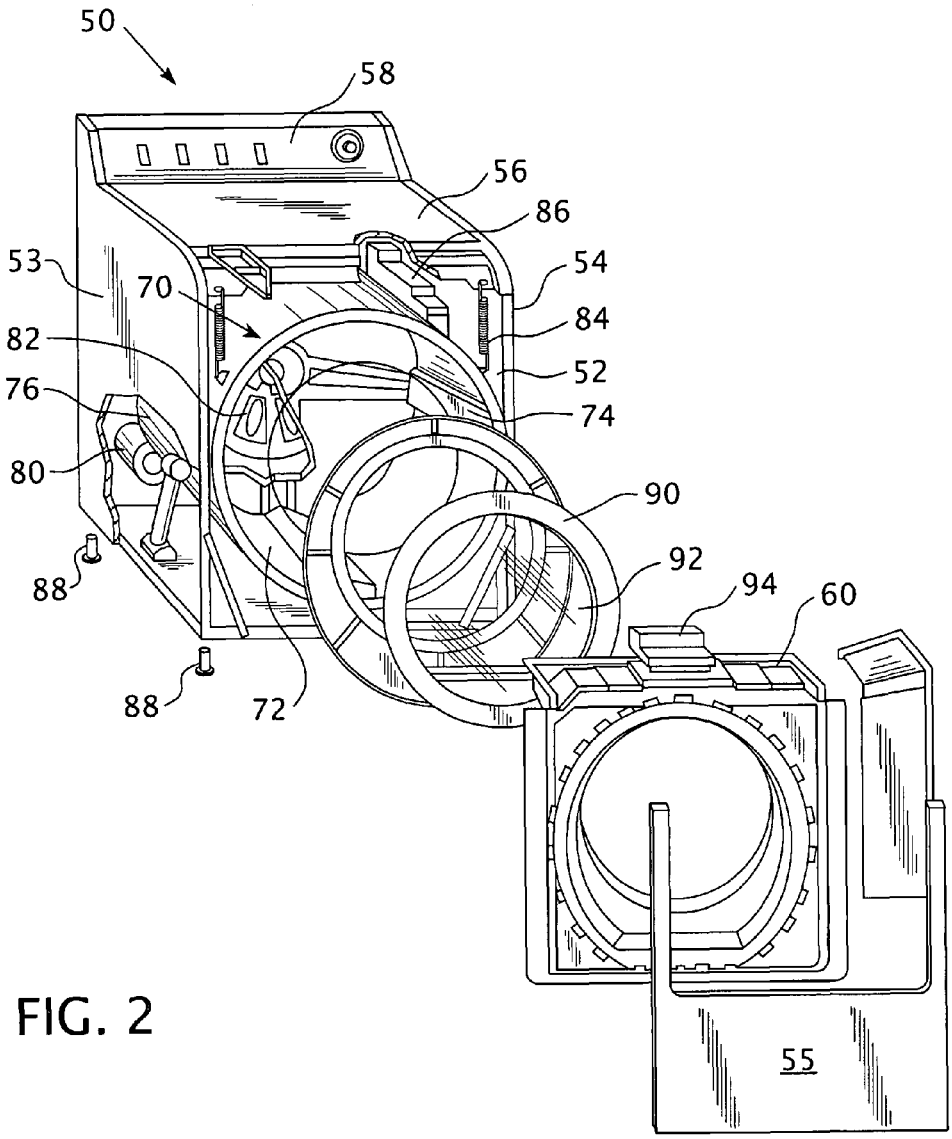
FIG. 2 is an exploded perspective, schematic view of a representative front loading washer.

Washing machines or washers that are top loading, and have substantial centrally rotating agitators may be secured for shipping by various other means. See, the top loader moving devices disclosed and patented above. The primary focus of this kit, and its preferred airbag apparatus, is to stabilize washers that are predominantly front-loading, i.e. have an access door in the forward vertical region, with the corresponding, rotating drum chamber running horizontal thereto. A representative front loading washer is shown, in an exploded perspective view, at FIG. 2. Particularly, that washer 50 includes a washer housing 52, with sidewalls 53, 54, a front panel 55 (moved forward of front door assembly 60 for better illustration) and top lid 56. Above this representative front-loading model, there is a control panel 58. Other models may locate their controls in the lid proper and/or along the upper front panel face.

Within the typical washer interior, there is a rotating drum mechanism 70, made up of an inner drum 72 that holds the clothing or other fabrics to be laundered. Inner drum 72 may include spaced apart vanes 74 for providing some agitation of the clothes as the drum rotates about a horizontally extending, central axis. Inner drum 72 revolves within a tub assembly 76 whose outer circumference runs at least partially parallel to sidewalls 53 and 54, with a gap between for some plumbing and electrical. Also included at various interior regions of washer 50 are a drive motor 80, drive pulley 82, tub springs 84 and counterweights 86. Vertically adjustable balancing legs 88 extend from the four corners of housing 52.

A seal 90 surrounds the opening to inner drum 72. A glass window 92 in door 60 allows viewing of the washer while in operation. Each washer door further includes a handle, atop as shown 94, or alternatively from one side of the washer front door. In the subsequent FIGS., common components are commonly numbered in the next hundred series.

Figure 3:
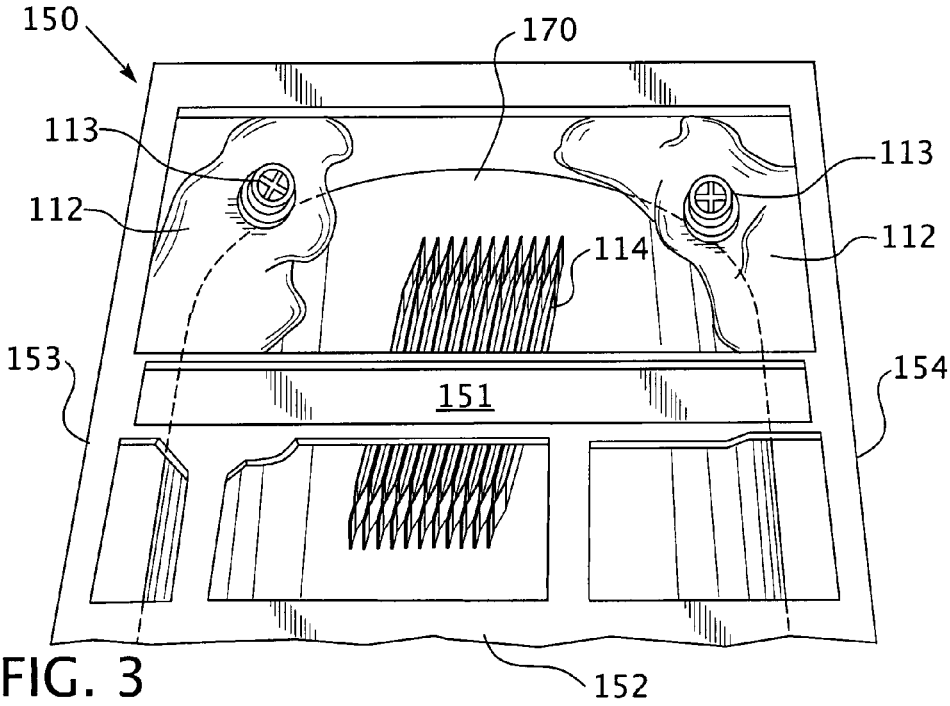
FIG. 3 is a top schematic view of the spacer and two uninflated airbags kit positioned about the drum of a front loading washer with its lid removed.
Figure 4:
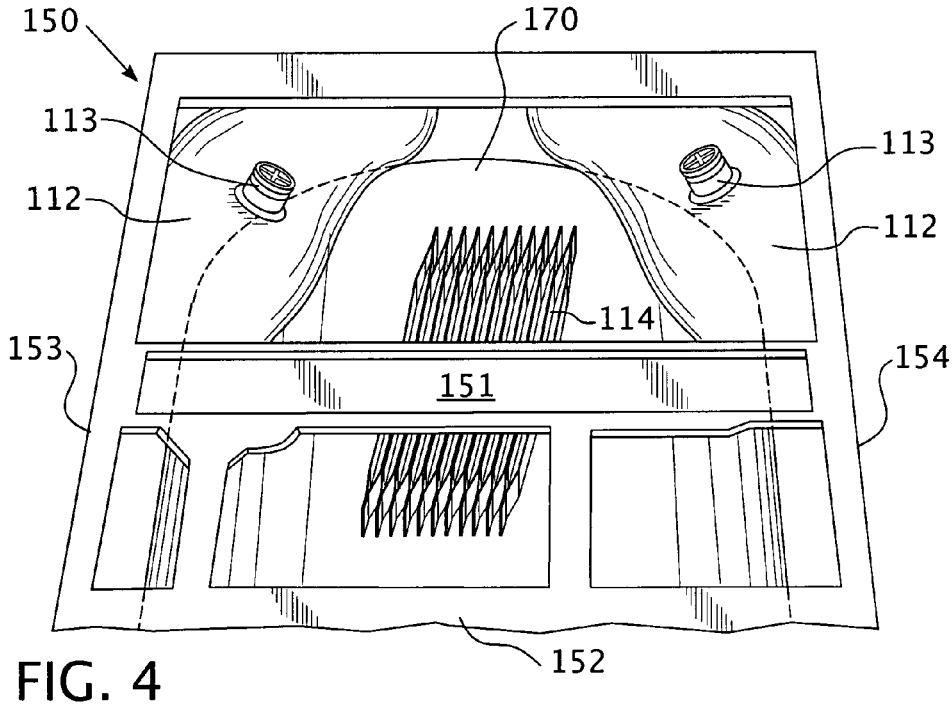
FIG. 4 is a top perspective view of the kit from FIG. 3 with the airbags inflated.

In FIGS. 3 and 4, a front loading washer unit, generally 150, is shown with its lid already removed. That allows access to the top of drum mechanism 170. A bracket 151 connects drum mechanism 170 to the top of washer housing 152, especially horizontally between the tops to washer sidewalls 153, 154. A folded cellblock, or spacer 114, is installed by forcing drum mechanism 170 downward by applying nominal pressure to the mechanism. That forces the drum in a direction away from bracket 151, in this case in the direction towards the floor of a front loading washer unit when in normal operation. With the drum mechanism duly, fully extended, the spacer (with the open cells of the corrugated cardboard strip facing any pressure point areas in the washer interior) can be used to provide initial drum mechanism cushioning. Ideally, that spacer 114 can be taped into place (not shown), or otherwise secured beneath bracket 151, and against the upper central point to the exterior of drum mechanism 170.

About the rear hemisphere of drum mechanism 170 still visible when the lid to washer 150 has been removed, there are several key areas in which to insert an airbag 112, for subsequent inflation via valve 113. This same valve will later serve as means for gradually deflating the same airbag after washer shipment has been completed.

In FIG. 3, there are two flat, uninflated bags, one situated in the left and the other in the right rear quadrant to the washer housing interior. Once properly inflated, these same airbags 112 will cushion the drum mechanism 170 from shock and other potentially damaging movements. It is not intended that the airbags fully immobilize the drum mechanism from rotating, or from moving at all within housing 152. Rather, the goal is to reduce, actually substantially minimize, the relative movement (or "jostling") of the drum in the washer being readied for relocation.

The airbags to be inflated should never be overly inflated. While the representative models herein have the ability to withstand up to about 1 psi of applied pressure, the bag units should never be taken to their full capacity. They are not meant to support the washer unit, or even the drum mechanism in same, for any length of time. And like any bag containing applied air pressure, they can burst during the appliance shipping process. Preferably, the bags are encased in an outer shell or casing, even one made of multi-ply paper, for making the bags less susceptible to accidental puncturing. Bags made from polymer skins alone are too prone to rupture . . . either during their initial positioning in the washer unit, or in the minor contacting with adjacent washer components, during bag shipment and/or washer shipment.

Figure 5:
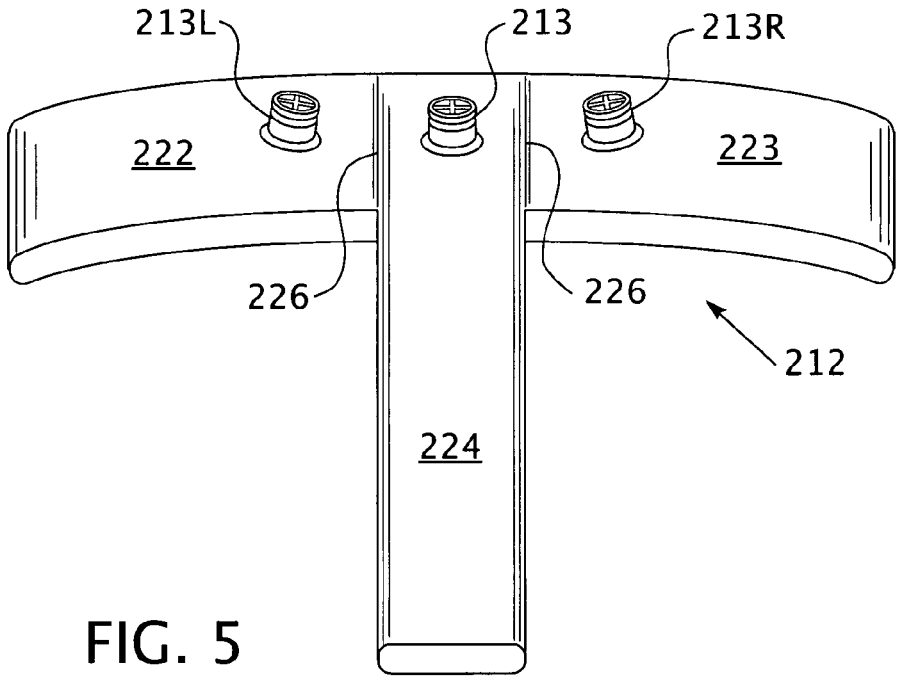
FIG. 5 is a top schematic view of an uninflated, airbag apparatus having multiple compartments according to an alternative embodiment of this invention.
Figure 6:
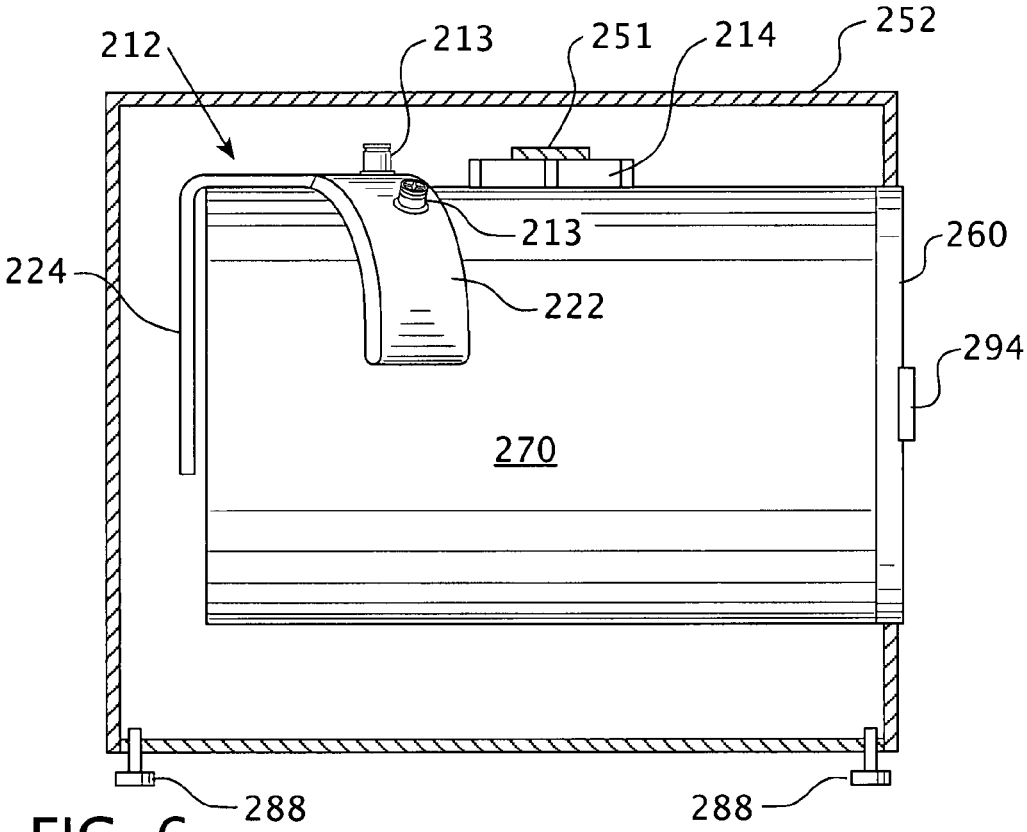
FIG. 6 is a side schematic view of the airbag apparatus from FIG. 5 positioned in a front loading washer prior to inflation.
Figure 7:
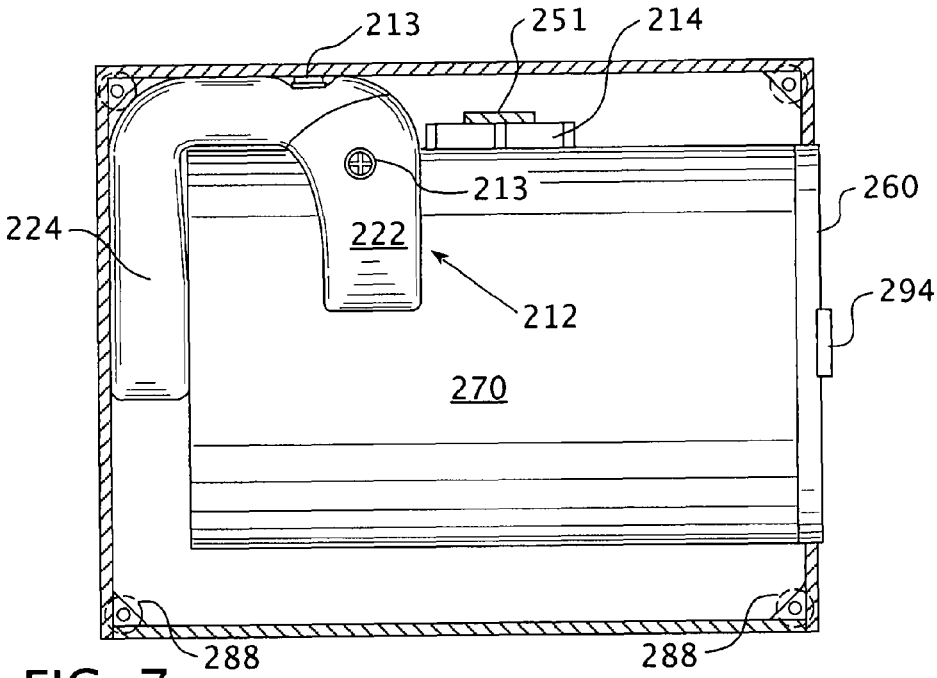
FIG. 7 is a top schematic view of the apparatus and washer from FIG. 6 after inflation.

In FIGS. 5 through 7, one preferred airbag alternative is schematically shown. FIG. 5 shows the bag schematic, alone. FIG. 6 shows the installation of an uninflated bag about the sides, and to the rear, of a front loading washer, drum mechanism. FIG. 7 shows the same schematic view of FIG. 6 with the airbag duly inflated about the washer drum mechanism. The latter two views also include a supplemental cushioning with the positioning of spacer 214 beneath housing bracket 251.

A preferred configuration of bag unit 212 is generally T-shaped. It has a left 222 and right 223 arm extension. From the middle of this airbag, a third lower arm 224 extends. As shown, the airbag has seamed breaks 226 between left, center and right arm extensions. And the unit proper can be filled with compressed air at once via valve 213. Alternately, the seamed breaks 226 can be made more definitive, thus purposefully dividing bag unit 212 into separate and distinct compartments. With such a division, additional left valve 213L and right valve 213R will be needed for filling the unit once properly positioned.

For those top loading washers having little or no centrally rotating agitator, many of the prior art washer securing means will not work. They have no agitator tip to clamp or otherwise foam around. The alternative aspects of FIGS. 8 and 9 show that with properly positioned bags 312, a sufficient degree of drum stabilization can be imparted without having to: tilt the whole washer unit on its back or side; otherwise disassemble the top loading washer lid (and usually, its adjacent control panel); or remove the washer backing for gaining access to the rear drum mechanism, often positioned behind plumbing, electrical and/or sound deadening components.

Figure 8:
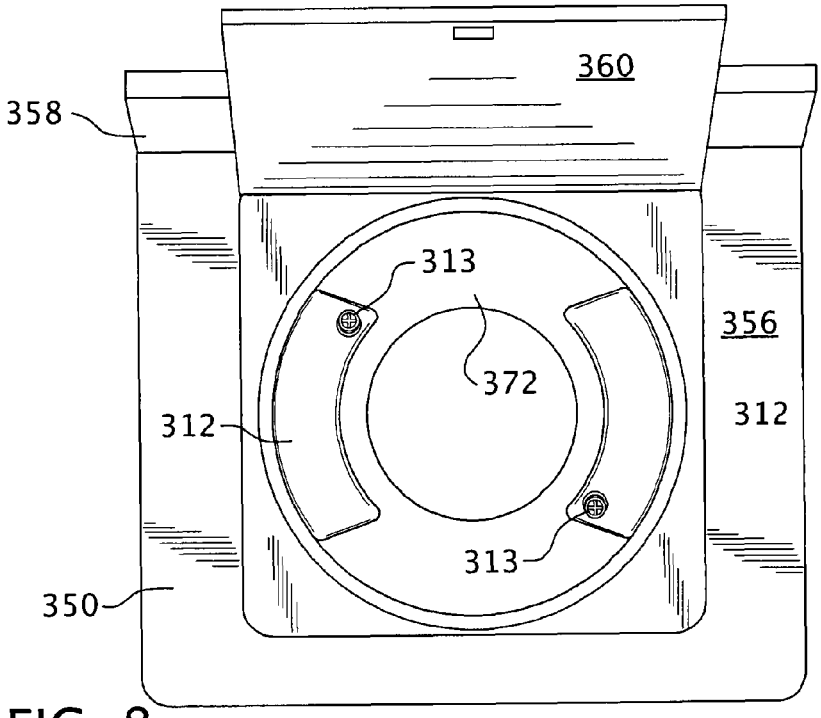
FIG. 8 is a perspective schematic view of uninflated airbags from a kit positioned about the drum of an agitator-less, top loading washer according to one embodiment of this invention.
Figure 9:
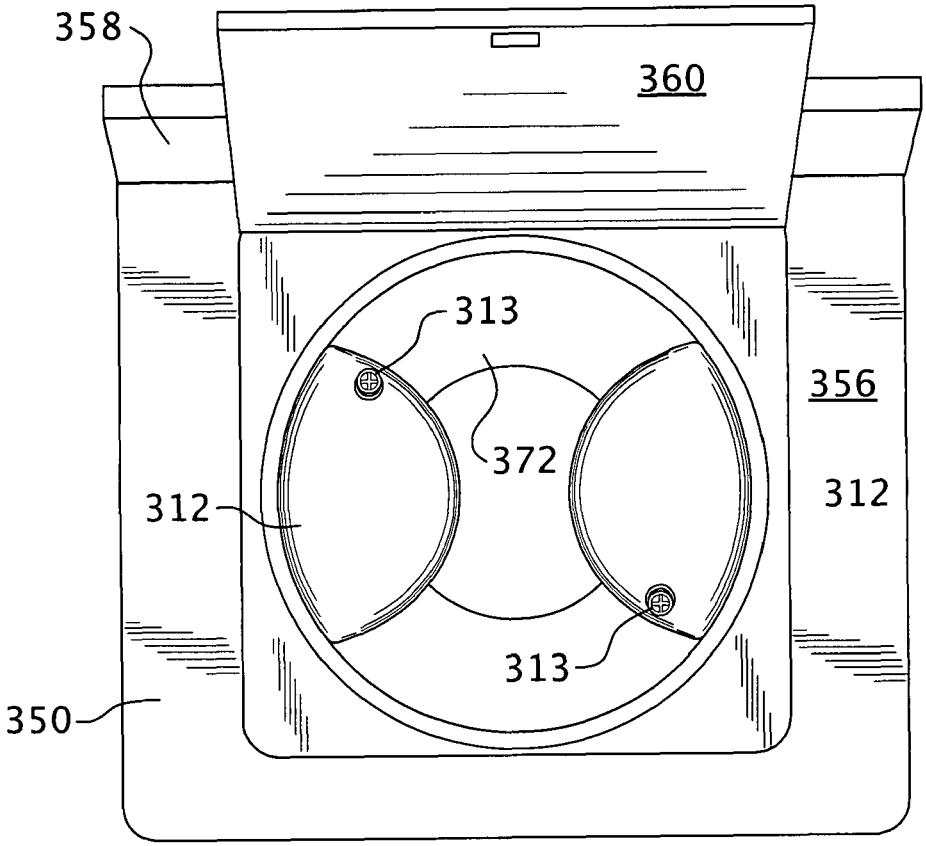
FIG. 9 is a perspective schematic view of the washer from FIG. 8 with airbags inflated.

In the side-by-side views of washer 350, FIGS. 8 and 9 show the same inner drum 372 through the top 356 of housing 352, with the top loading, drum lid 360 raised and resting against control panel 358 for better illustration. The interior to inner drum 372 is where clothes are situated, and detergents added, for subsequent washing. Rather than fully disassembling the washer proper, or relying on known alternate means for stabilizing a top loading washer having a full, central agitator, this embodiment employs a plurality of airbags each of which will drape partially into, and partially over then slightly down and about the exterior to inner drum 372 as it sits within its equivalent outer drum mechanism (not shown). Once inflated through valve 313, these bag apparatus will sufficiently secure the washer drum from nominal shaking or jostling for the brief time that the whole unit gets transported between points A and B.

Figure 10:
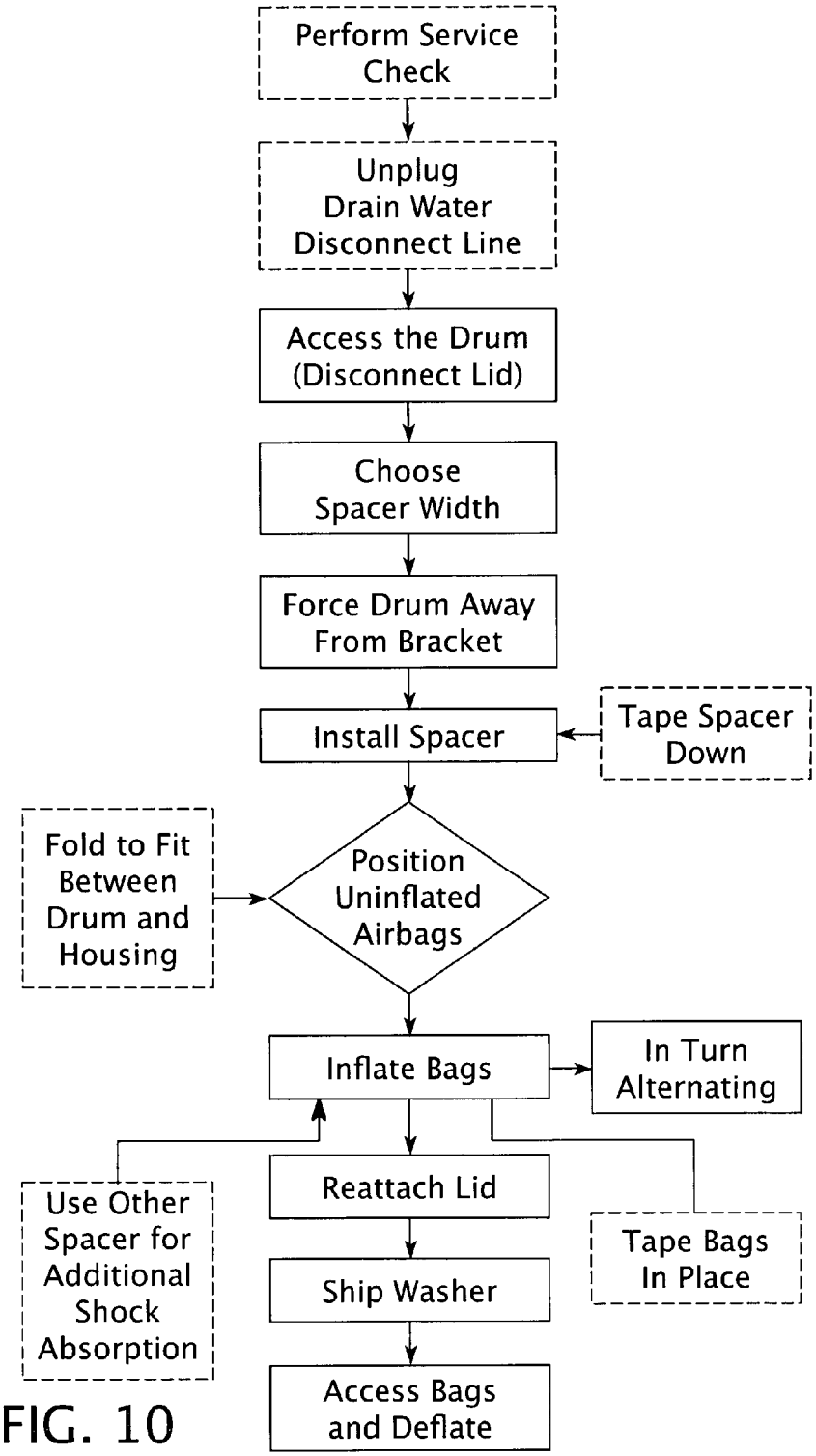
FIG. 10 is a flowchart depicting one preferred method for securing a washer according to this invention with optional steps shown in dotted lines.

FIG. 10 shows the various method steps for using the apparatus and kit of this invention to secure a washer unit for shipping. In that flowchart, optional steps are shown with dotted lines. For instance, before any washer unit is readied for transport, it is critical for professional service technicians to perform a typical service check, i.e. making sure that all was operationally sound before the packing process is begun. Next, the washer unit should be unplugged, any remaining water in same drained and the water pressure line connects (and the outgoing drain tubes as well) disconnected. Then, in conjunction with preferred method steps, the drum to the washer unit should be accessed. For most front loading washers, that means removing the top to the washer housing, typically by unscrewing a few bolts or connectors.

Next, FIG. 10 suggests that the installers of kits such as these visually inspect the top to the washer drum mechanism for ascertaining which supplied spacer unit width to insert between drum top and its nearest upper housing bracket. With only a slight downward push, in a direction opposite the housing bracket, the drum can be forced sufficiently for the accordion-like spacer (or cellblock) to be fitted therebetween. That spacer serves as a first line of defense against initial drum mechanism movement. Preferably, the spacer can be taped into place against one or more adjoining washer interior components.

For better supplementing that initial drum mechanism securement, at least one and preferably several, stand alone airbags are positioned between the drum mechanism and inner walls to the washer housing. Depending on the spacing available, it may prove practical to bend or fold over one or more bags before wedging them into place, being careful not to disturb adjacent plumbing and/or electrical washer components. Once the bags are in place, next steps dictate filling the duly situated airbags using an electric compressor, a small, handheld air canister or manual handheld pump. When multiple bags need to be filled, it is recommended (though not required) that the bags be filled (a) intermittently: and (b) in an alternating fashion. In that way, the complete filling of one bag (at the expense of its sister bag situated in an opposite corner of the same washer interior) won't unduly stress the drum mechanism in any one forced direction over the other. Instead, the whole unit will be kept "less disturbed" by partially filling bag A, then bag B, returning to add more to A, then B, before completing the airbag filling process, once more in turn.

After the bags have been filled, they can be taped to adjacent washer interior components for assuring their positioning, especially in the event of leakage, or possible inadvertent bag puncturing on only one side of the washer interior. Should additional shock proofing warrant, the unused spacer included with the kits can be divided, torn and/or wedged for inserting between the drum and washer housing at other contacting points.

Finally, as FIG. 10 so shows, the washer lid can be reattached and the secured washer unit moved from its initial location to its next "home". Once shipped, it is preferred that the washer lid be removed once more and the airbags gradually deflated through the bleeding of air back through the same air filling valves. If the situation warrants, both airbags can also be pierced with a sharp, pointed object, preferably near simultaneously, so as to not unduly stress the drum mechanism in one direction or the other upon removal of the kit stabilization bags.

The present invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. A method for securing an automatic washer for shipping comprises:

removing a panel of the washer for access to a drum mechanism for positioning an uninflated bag;

positioning the uninflated airbag between the drum mechanism of the washer and an adjoining inner wall of the washer; and inflating the airbag to wedge between the drum mechanism and the inner wall for shipment.

2. The method of claim 1, further comprising the step of deflating the airbag after the washer has been shipped.

3. The method of claim 1, further comprising the steps of:

measuring a distance between the drum mechanism and an adjacent housing bracket;

selecting a spacer having a height larger than the measured distance;

moving the drum mechanism away from the housing bracket; and positioning the select spacer between the drum mechanism and the housing bracket.

4. The method of claim 3, further comprising the step of securing the positioned airbag or spacer with tape.

5. The method of claim 1, wherein the airbag has a plurality of elongated compartments.

6. The method of claim 5, wherein each compartment of the airbag is inflated individually during the inflation step.

7. The method of claim 6, wherein each compartment is inflated incrementally in an alternating manner.

8. The method of claim 1, wherein the washer has a front loading door and the panel is a top section of the washer.

9. A method for securing an automatic washer for shipping, comprising the steps of:

selecting a spacer having a height larger than a distance between a drum mechanism of the washer and an adjacent housing bracket;

moving the drum mechanism away from the housing bracket and positioning the select spacer between the drum mechanism and the housing bracket;

positioning an uninflated airbag between the drum mechanism and an adjoining inner wall of the washer; and inflating the airbag to wedge between the drum mechanism and the inner wall for shipment.

10. The method of claim 9, further comprising the step of deflating the airbag after the washer has been shipped.

11. The method of claim 9, further comprising the step of removing a panel of the washer for access to the drum mechanism for positioning the uninflated bag.

12. The method of claim 11, wherein the washer has a front loading door and the panel is a top section of the washer.

13. The method of claim 9, further comprising the step of securing the positioned airbag or spacer with tape.

14. The method of claim 9, wherein the airbag has a plurality of elongated compartments.

15. The method of claim 14, wherein each compartment of the airbag is inflated individually during the inflation step.

16. The method of claim 14, wherein each compartment is inflated incrementally in an alternating manner.

17. A method for securing an automatic washer for shipping comprises:

unsecuring a panel of the washer for access to a drum mechanism for positioning an uninflated bag;

positioning the uninflated airbag between the drum mechanism of the washer and an adjoining inner wall of the washer; and inflating the airbag to wedge the airbag between the drum mechanism and the inner wall for shipment.

18. The method of claim 17, wherein the washer has a front loading door and the panel is a top section of the washer.

19. The method of claim 18, wherein the airbag has a plurality of elongated compartments.

* * * * *